US005779452A

United States Patent [19]

McCombie

[11] Patent Number: 5,779,452

[45] Date of Patent: Jul. 14, 1998

[54] POSITIVE DISPLACEMENT PUMP OR MOTOR UTILIZING A RECIPROCAL SLIDING MEMBER TO OPERATE THE SUCTION AND DISCHARGE PORTS

[76] Inventor: Alan Keith McCombie, 12 Darlington Place, Bath BA2 6B3, Great Britain

[21] Appl. No.: 637,697

[22] PCT Filed: Oct. 31, 1994

[86] PCT No.: PCT/GB94/02390

§ 371 Date: Jul. 15, 1996

§ 102(e) Date: Jul. 15, 1996

[87] PCT Pub. No.: WO95/12758

PCT Pub. Date: May 11, 1995

[30] Foreign Application Priority Data

Oct. 30, 1993 [GB] United Kingdom ..... 9322451

[51] Int. Cl.[6] ..... F04B 1/04

[52] U.S. Cl. ..... 417/273; 417/293; 137/625.25

[58] Field of Search ..... 417/273, 493; 92/72; 137/625.25

[56] References Cited

U.S. PATENT DOCUMENTS

| | | | |
|---|---|---|---|
| 1,630,953 | 5/1927 | Levine . | |
| 3,104,618 | 9/1963 | Holdener . | |
| 3,211,107 | 10/1965 | Bush . | |
| 4,605,360 | 8/1986 | Swartwood | 137/625.25 |
| 4,907,950 | 3/1990 | Pierrat | 417/273 |
| 5,004,404 | 4/1991 | Pierrat | 417/273 |

FOREIGN PATENT DOCUMENTS 822155 10/1959 United Kingdom .

OTHER PUBLICATIONS

"Baseplates and Drives", *Mono Merlin Options & Variations*, Brochure, Mono Ltd., 1 page, (Pub. prior to Oct. 30, 1993).

"Jabsco Industrial Pump Range", Brochure, Jabsco Ltd., pp. 2–3, (Pub. prior to Oct. 30, 1993).

"Operating Instructions and Parts List", *Megator Types L+H Pumps*, Megator Pumps & Compressors Ltd., Sunderland, England, pp. 1–19, (Aug. 1978).

*Primary Examiner*—Timothy Thorpe
*Assistant Examiner*—Cheryl J. Tyler
*Attorney, Agent, or Firm*—Schwegman, Lundberg, Woessner & Kluth, P.A.

[57] ABSTRACT

A central impeller is sandwiched between fixed walls and is driven through a circular path of small radius, but prevented from rotating by a ring-shaped shutter or slider which surrounds and guides it. The shape of the impeller and slider are such that displacement chambers are formed between them, which expand and contract as the impeller follows a circular path and imparts a reciprocating motion to the slider. The two fixed walls contain suction and discharge ports which are covered and uncovered by the impeller and the slider as they perform their motions.

20 Claims, 12 Drawing Sheets

POSITIVE DISPLACEMENT PUMP OR MOTOR UTILIZING A RECIPROCAL SLIDING MEMBER TO OPERATE THE SUCTION AND DISCHARGE PORTS

This invention relates to pumps and in particular to positive displacement pumps.

Typically these pumps may be used in industry, in mines and on shipboard for raising and transferring water, oil, liquid products, effluent and so on. Such pumps will vary in capacity from 20 litres/minute to 1,000 litres/minute and will be capable of creating a suction of 7 metres of water and a delivery pressure of up to 8 bar. Sometimes they will need to be self-priming and able to handle a mixture (or alternation) of liquid and gas, as well as small solid particles suspended in liquids.

Hitherto such pumps have mainly been based on the progressive cavity screw principle (manufactured for example by Mono), the meshing gear or lobe principle (Jabsco et al), the sliding-shoe principle (Megator Limited) or the classic triple-ram principle. These are known as positive-displacement pumps to distinguish them from centrifugal pumps, which do not meet the performance criteria outlined above.

The performances of such pumps usually depend upon fine clearances between the working components and the manufacturers therefore have to make a painful choice between low performance and high cost of manufacture. If the material being pumped is abrasive or contains gritty particles, wear of the components will cause these clearances to increase rapidly and degrade the performance.

This drawback is not shared by the sliding-shoe pump, in which one moving part is slightly flexible and envelopes the other moving part in such a way that they are squeezed together by the pressure developed in pumping. Thus a tight seal is maintained even after considerable wear has taken place. This type of pump is therefore exceptionally positive and can develop an unusually high suction. The sliding-shoe pump is also inherently self-priming because the body, in which the pumping elements are submerged, always remains full of liquid even though the pump may temporarily be pumping only air.

This combination of virtues is offset by the following disadvantages of the sliding-shoe pump:—it is expensive, comprising intricate castings and sophisticated mouldings (the shoes), all of which parts have to be in a range of sizes; it contains hidden passages and recesses and is therefore unattractive to the food industry on sanitary grounds; it cannot be run in reverse; it cannot readily be constructed in stainless steel or plastics; it is noisy and vibrates; it is bulky and heavy; and there is a loss of volumetric efficiency due to the virtual line contact between the shoes and the rapidly rotating discs.

GB-822155 (Megator) discloses a pump comprising a plurality of pairs of pistons, each slidably mounted within its own associated cylinder, the cylinder having inlet ports and outlet ports for the entry and egress of fluid. The pistons are connected to eccentric parts driven by a shaft which move the pistons back and forth inside the cylinder and bring the ports into and out of registration with the inlets and outlets. GB-843420 (Holdener) discloses a pump having four radially directed pistons rigidly arranged on a ring and each running in a cylinder. The ring is mounted on an eccentric driven by a shaft. The cylinders are guided so as to be transversely displaceable by the eccentric movement so that ports in the pump housing into are brought registration with inlet and outlet ports for the cylinder. These pumps have a great many moving parts, however, and are bulky for the volume of fluid they can pump per revolution.

It is one object of a first aspect of the present invention to provide an alternative pump which for example has some of the same advantages as the sliding-shoe pump, but which overcomes some or all of the drawbacks listed above. This is achieved in one embodiment by means of a novel construction, in which a central impeller is sandwiched between fixed walls and is driven through a circular path of small radius, but is prevented from rotating by a ring-shaped shuttle or slider which surrounds and guides it. The shape of the impeller and slider are such that displacement chambers are formed between them, which expand and contract as the impeller follows its circular path and imparts a reciprocating motion to the slider. The two fixed walls may contain suction and discharge ports respectively, which are covered and uncovered by the impeller and slider as they perform their motions.

In particular embodiments the impeller and slider can be configured in such a way that only the relevant suction ports are uncovered while a displacement chamber is expanding and only discharge ports are uncovered while it is contracting. Consequently, if the whole system is immersed in a liquid, there will be positive pumping action in which liquid is drawn into the chambers through one wall and discharged out through the other.

In accordance with another aspect of the invention, the parts thus described or parts of similar function may be disposed within a vessel, which may be the body of a pump, such that the vessel is divided into two spaces, the suction space and the discharge space. The spaces are then connected to an inlet and an outlet respectively, and may be arranged in such a way that the walls are largely surrounded by liquid at discharge pressure. If the walls are slightly flexible, the pressure developed by the pumping action will tend to squeeze them together, thus creating a close seal between the working parts even after wear has taken place.

According to another aspect of the invention, if for some reason the inlet becomes void of liquid, the discharge space of such a pump, or a pump having similar operation, can be designed so as to remain full of liquid even though the pump is only drawing air. Thus the parts will continue to be lubricated by the liquid, allowing the pump to run 'dry' for long periods and to prime itself immediately on the arrival of further liquid at the inlet.

In accordance with yet another aspect of the invention the parts of a pump similar to that described above may be arranged behind a removable cover so that they may all be very easily removed for cleaning or inspection; at the same time all other wetted parts of the pump, including the single mechanical seal, will become fully visible and accessible.

In a particular embodiment of the present invention, a horizontal rotating drive shaft (which can be an extension of the shaft of an electric motor) protrudes through the wall of a vessel comprising the main body of a pump. A conventional mechanical seal allows the shaft to rotate without leakage occurring from within the vessel, which is full of the liquid to be pumped. Rigidly mounted on the free end of the shaft is a simple eccentric with an eccentricity of the order of six to twelve millimetres.

The eccentric fits into the bore of an impeller, which is sandwiched between two walls or 'port plates' which are transversely mounted right across the interior of the pump. The impeller is substantially rectangular in shape with the bore at the centre. Completely surrounding it, in the same plane, is the ring-shaped slider. The impeller and slider are of the same uniform thickness, which is slightly less than the space between the port plates so that both can slide freely within that space.

The upper and lower rectangular ends of the impeller fit into vertical slideways formed on the inside of the slider. This means that relative motion between impeller and slider is only possible in the vertical direction. The slider itself, however, is mounted so that it can only move horizontally. To achieve this, the slider has horizontal slideways, which slide upon fixed lugs on opposite sides of the pump chamber.

When the shaft is rotated, the impeller is driven through a circular path by the Eccentric but cannot itself rotate because it is constrained by the slider. As it moves, the impeller drives the slider to and fro horizontally with simple harmonic motion, and itself performs a simple harmonic motion within the slider in the vertical direction.

In such an embodiment, in accordance with yet another aspect of the invention, four expanding and contracting chambers are thus created: two between the impeller and the slider in the vertical sideways and two between the outside of the slider and the fixed lugs.

The same embodiment provides, in accordance with yet another aspect of the invention, two other chambers, of constant volume, that may be formed between the vertical sides of the impeller and the inside of the slider. If the vertical sides of the slider are pierced, each of these chambers becomes integral with the adjacent expanding and contracting chamber associated with the fixed lugs as mentioned above.

The same embodiment provides, in accordance with yet another aspect of the invention, four displacement chambers, each of which contains a moving wall which slides to and fro at right angles to the direction of displacement and is timed at 90°, ie the displacement velocity is maximum when the moving wall is at rest and vice versa. This relative motion allows the moving wall to be used to cover and uncover appropriate suction and discharge ports cut into the port plates in such a way that the flow of fluid into or out of a given displacement chamber is proportioned to the displacement velocity of that chamber.

The above and other aspects of the invention may be combined or omitted to implement a wide range of pumps, some of which will be less susceptible to the problems described above, and other problems known to those skilled in the art.

There follows a description, by way of example, of specific embodiments of the present invention, reference being made to the accompanying drawings in which.

Figure 1:
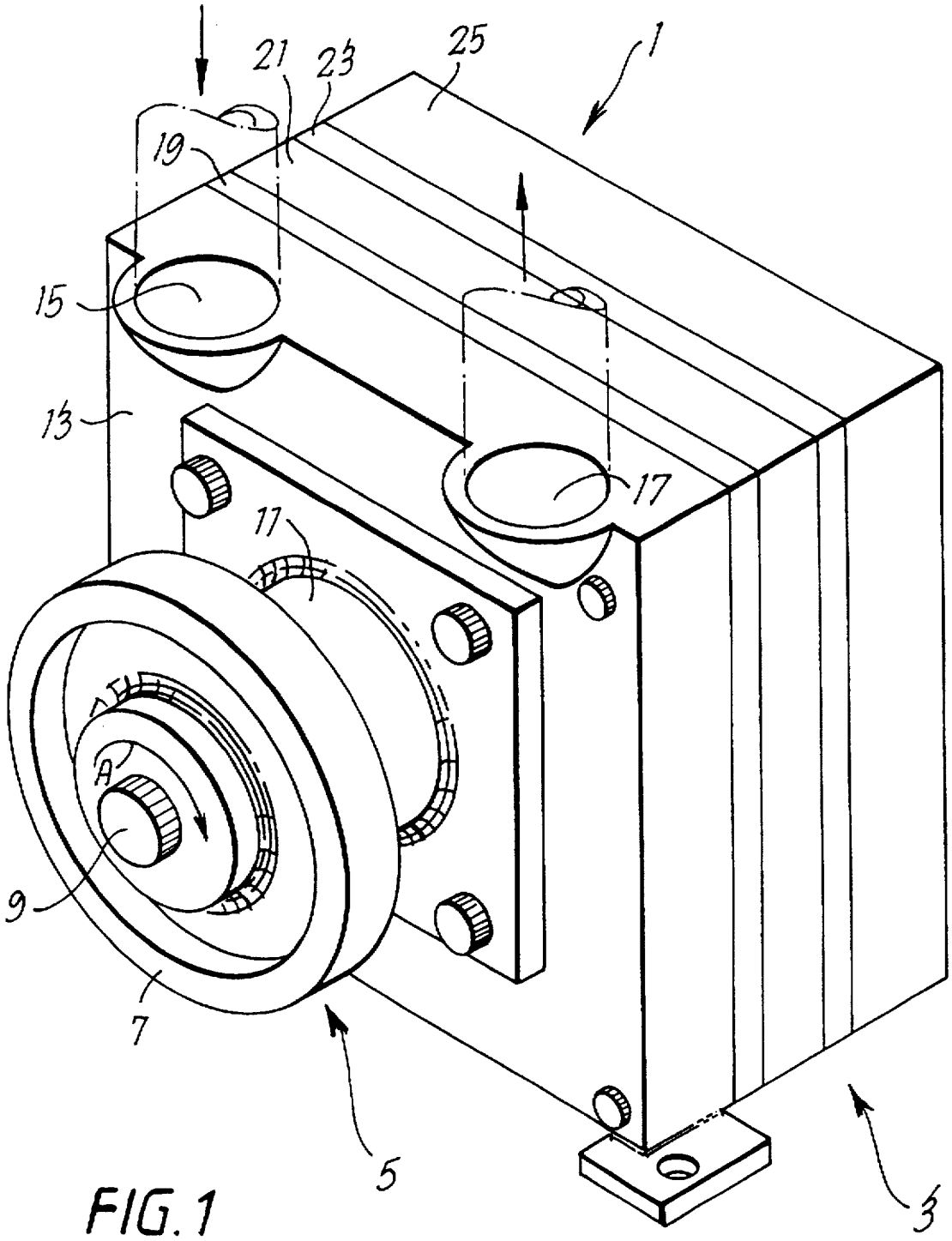
FIG. 1 is a diagrammatic perspective view of a pump according to the present invention including a drive means and a pump assembly.

With reference to FIG. 1 the pump 1 comprises a pump assembly 3 and a drive means 5. The drive means comprises a pulley 7 mounted on one end of a shaft 9, the shaft 9 being mounted for rotation in a shaft housing 11 attached to the pump assembly 3. The pump assembly 3 comprises an inlet/outlet manifold 13 having an inlet 15 and an port 17 in its upper surface, an inlet port plate 19, a pumping unit 21, an outlet port plate 23 and return manifold 25. The parts of the pump assembly 3 may be held together by bolts or clamps (not shown) or any other suitable fixing means.

The end of the shaft 9 distant from the pulley 7 (not shown in FIG. 1) is engaged with the pumping unit 21 so that rotation of the pulley 7 in a clockwise direction indicated by arrow A will cause fluid to be pumped in through the port 15, through the pump assembly 3 and out through the port 17. Details of how the pumping unit 21 converts the rotary motion of the shaft 9 into a pumping action will be described below with reference to FIGS. 3 to 11.

Figure 2:
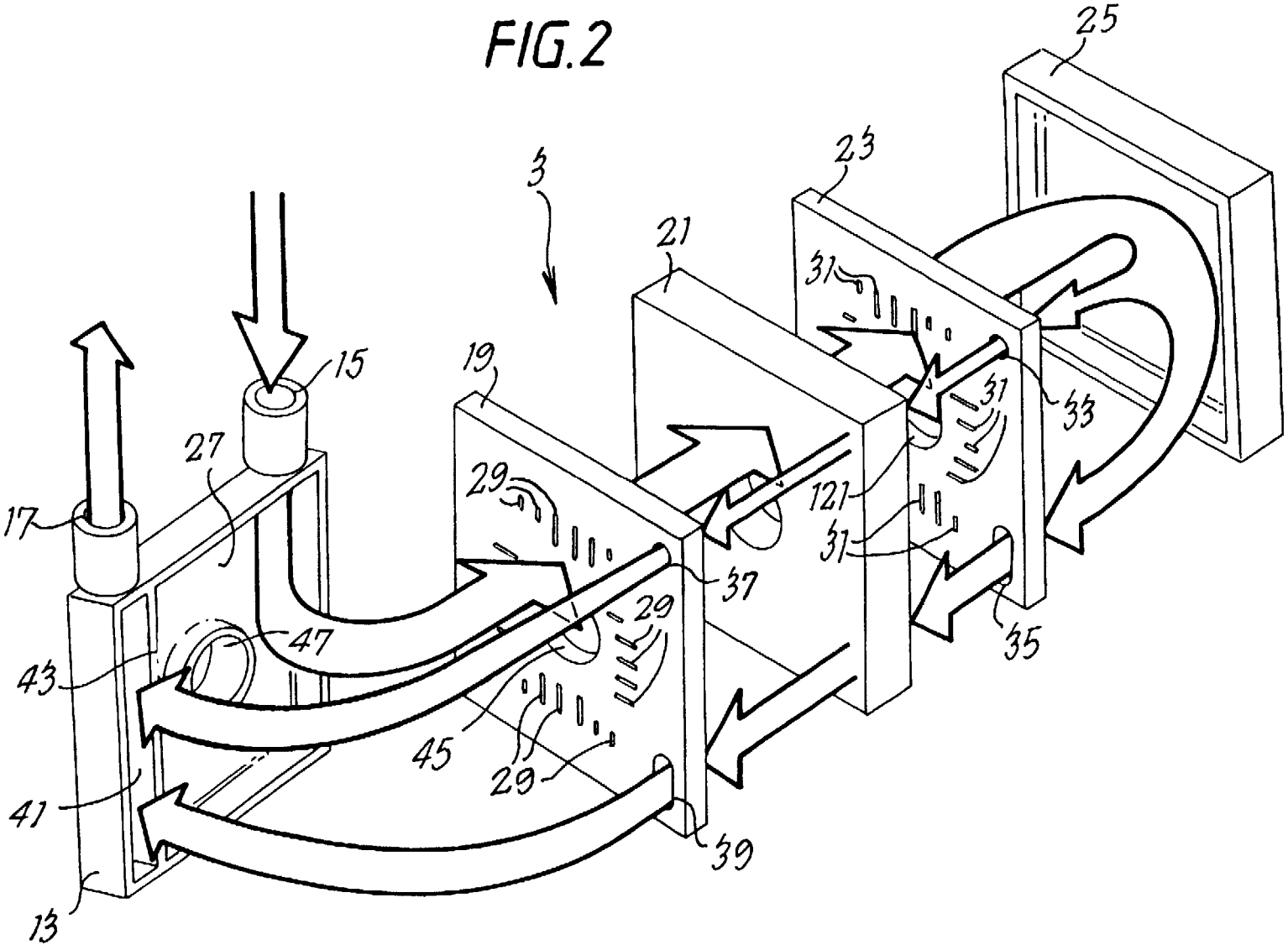
FIG. 2 is an exploded view of the components which make up the pump assembly including a pumping unit.

FIG. 2 is an exploded view of the pump assembly 3 with the flow of liquid through the pump indicated schematically by bold arrows and the pumping unit 21 shown schematically without detail. In use, the pumping action of the pumping unit 21 draws fluid into the inlet/outlet manifold 13 via the fluid inlet 15. From an inlet space 27 of the inlet/outlet manifold 13, fluid is drawn through the inlet port plate 19 via inlet ports 29 into the pumping unit 21. From the pumping unit 21 the fluid is forced out through the outlet port plate via outlet ports 31 into the return manifold 25. The return manifold 25 directs the fluid back through the outlet port plate 23 via upper and lower return ports 33,35 into the pumping unit 21. From the return ports 33 and 35 fluid flows freely through the pumping unit 21, via chambers (not shown) in the pumping unit 21 and through the inlet port plate 19 via upper and lower return ports 37,39 into the outlet portion 41 of the inlet/outlet manifold 13 and out of the pump assembly 3 via outlet 17.

The inlet/outlet manifold 13 is provided with a central cylindrical wall 43 which, in use, forms an annular seal around a hole 45 in inlet port plate 19. The shaft 9 (not shown) passes through an opening 47 in the inlet/outlet manifold 13 and the hole 45 in the inlet port plate 19 to engage with the pumping unit 21. A conventional mechanical seal (not shown) is provided to engage with the shaft 9 to prevent fluid escaping from the pump assembly out through the opening 47.

Figure 3:
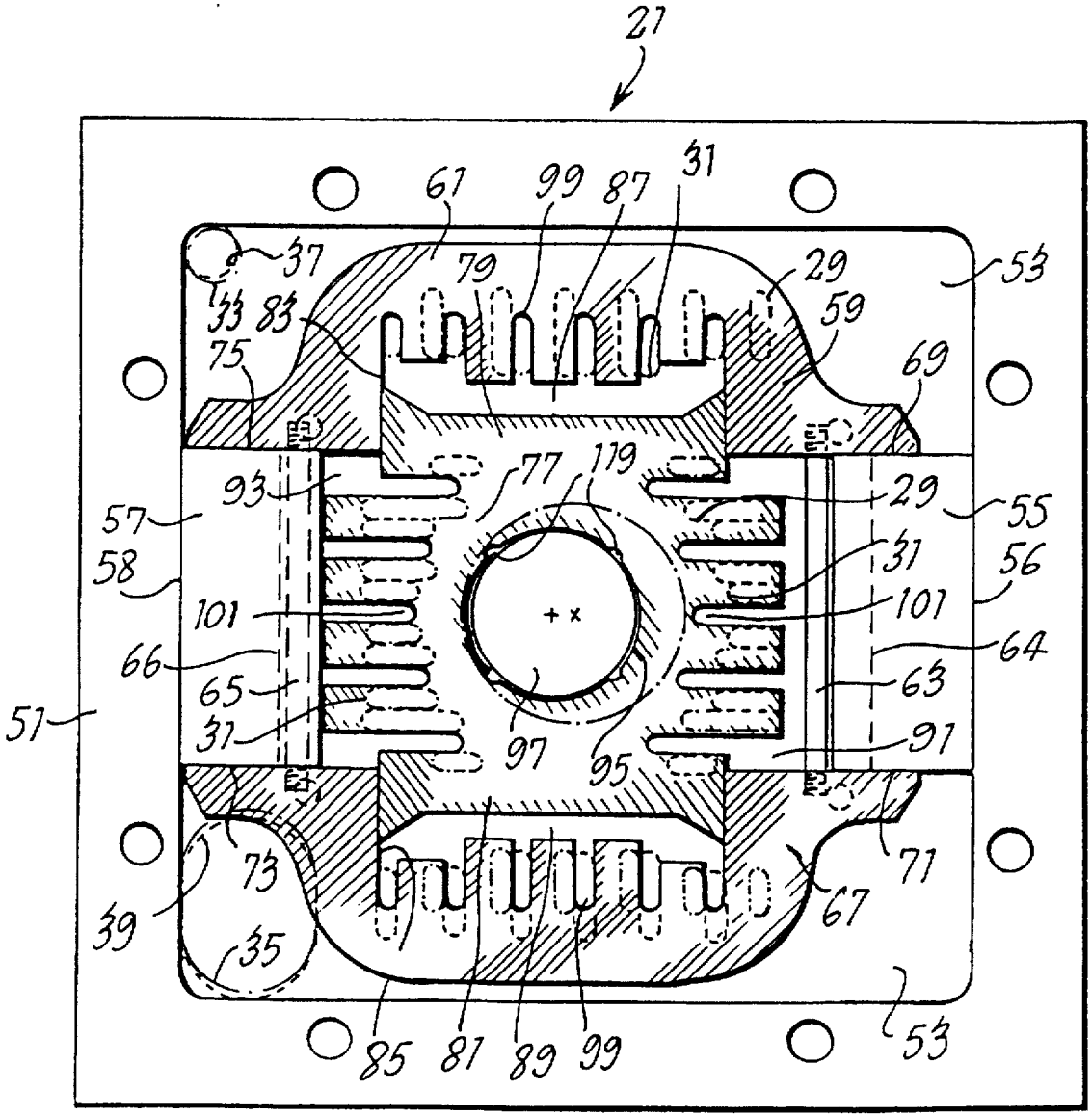
FIG. 3 is a front view of the pumping unit shown in FIG. 2.

FIG. 3 is a front view of the pumping unit 21 which comprises a square spacer ring 51 having a hollow interior 53. Two blocks 55,57 of rectangular cross-section are mounted in fixed positions on opposing interior walls 56,58 of the spacer ring 51. A slider 59 comprises an upper yoke 61 rigidly attached by rods 63,65 to a lower yoke 67. Upper and lower yokes 61,67 are provided with bearing surfaces 69,71,73,75 at each inwardly facing side of their ends which are slidably engaged with the horizonal sides of the blocks 55,57 thereby permitting the slider to be moved from side to side. Additionally, recesses 64,66 are provided in the inward ends of blocks 55,57 for accommodating the rods 63,65 as the slider moves from side to side.

An impeller 77 is situated generally centrally in the interior of spacer ring 51 having generally rectangular upper and lower ends 79,81 which are slidably mounted in generally rectangular spaces 83,85 formed in the upper and lower yokes 61,67 respectively thereby permitting the impeller to be moved upwardly and downwardly so that its ends 79,81 slide within the spaces 83,85. As the impeller is moved downwardly, a chamber 87 formed between the upper end 79 of the impeller and the upper yoke 61 of the slider 59 is expanded and another chamber 89 formed between the lower end 81 of the impeller 77 and the upper yoke 67 of the slider 59 is contracted. Conversely, when the impeller is moved upwardly, the upper chamber 87 is contracted and the lower chamber 89 is expanded.

Two further chambers are provided. A right chamber 91 is formed between the right hand block 55, the inwardly facing surfaces 69,71 of the upper and lower yokes 61,67 of the slider 59 and the right hand side of the impeller. A left chamber 93 is correspondingly formed by the left hand block 57, the inwardly facing surfaces 73,75 of the upper and lower yokes 61,67 of the slider 59, and the left hand side of the impeller 77. Accordingly, as the impeller is moved to the right the right chamber 91 is contracted and the left chamber 93 is expanded. When the impeller 77 is moved to the left the left chamber 93 is contracted while the right chamber 92 is expanded.

The impeller 77 has a central bore 95 in which an eccentric 97 is rotatably mounted. The eccentric 97 is engaged for rotation on the end of the shaft 9 distant from the pulley 7 (shown in FIG. 1). In FIG. 3 the centre of the eccentric 97 is marked by a small cross "+" and the centre of rotation of the shaft 9 is marked with a small diagonal cross "x".

The upper surface of the upper chamber 87 (on the upper yoke 61) and the lower surface of the lower chamber 89 (on the yoke 67) are provided with slots 99. The innermost surfaces of the right hand chamber 91 and the left hand chamber 93 (both on the impeller 99) have similar slots 101. As shown in FIG. 1, when the pump is assembled, the pumping unit 21 is sandwiched between the inlet port plate 19 and the outlet port plate 23 which have inlet ports 29 and outlet ports 31 respectively. The position of the inlet ports 29 and the outlet ports 31 relative to the parts of the pumping unit 21 are indicated on FIG. 3, with dash lines indicating the inlet ports 29 and chain dotted lines indicating the outlet ports 31. In FIG. 3 the inlet port plate 19 would be attached behind the pumping unit 21 and the outlet port plate 23 would be situated in front of it. FIG. 3 also shows in the same manner the upper return ports 33,37 and the lower return ports 35,39 in the inlet port plate 19 and the outlet port plate 23 respectively.

The slots 99 in the slider 59 are arranged such that as the slider moves back and forth the slots 99 cooperate with the inlet and outlet ports 29,31 to bring the chambers 87,89 into communication with the inlet and outlet ports 29,31. Similarly, the slots 101 in the impeller 77 are arranged so that as the impeller moves up and down the slots 101 cooperate with the inlet and outlet ports 29,31 to bring the right and left chambers into communication with the inlet and outlet ports 29,31.

The pumping action of the pumping unit 21 will now be described with reference to FIGS. 4 to 11. These figures are front views and are similar to the view shown in FIG. 3 except that, for clarity, the rods 63,65, the eccentric 97 and the cross hatching shown in FIG. 3 have been omitted. The pumping action will be described firstly in relation to the upper chamber 87, throughout one complete cycle, and then in relation to the right chamber 91 and the other chambers 89, 93.

Figure 4:
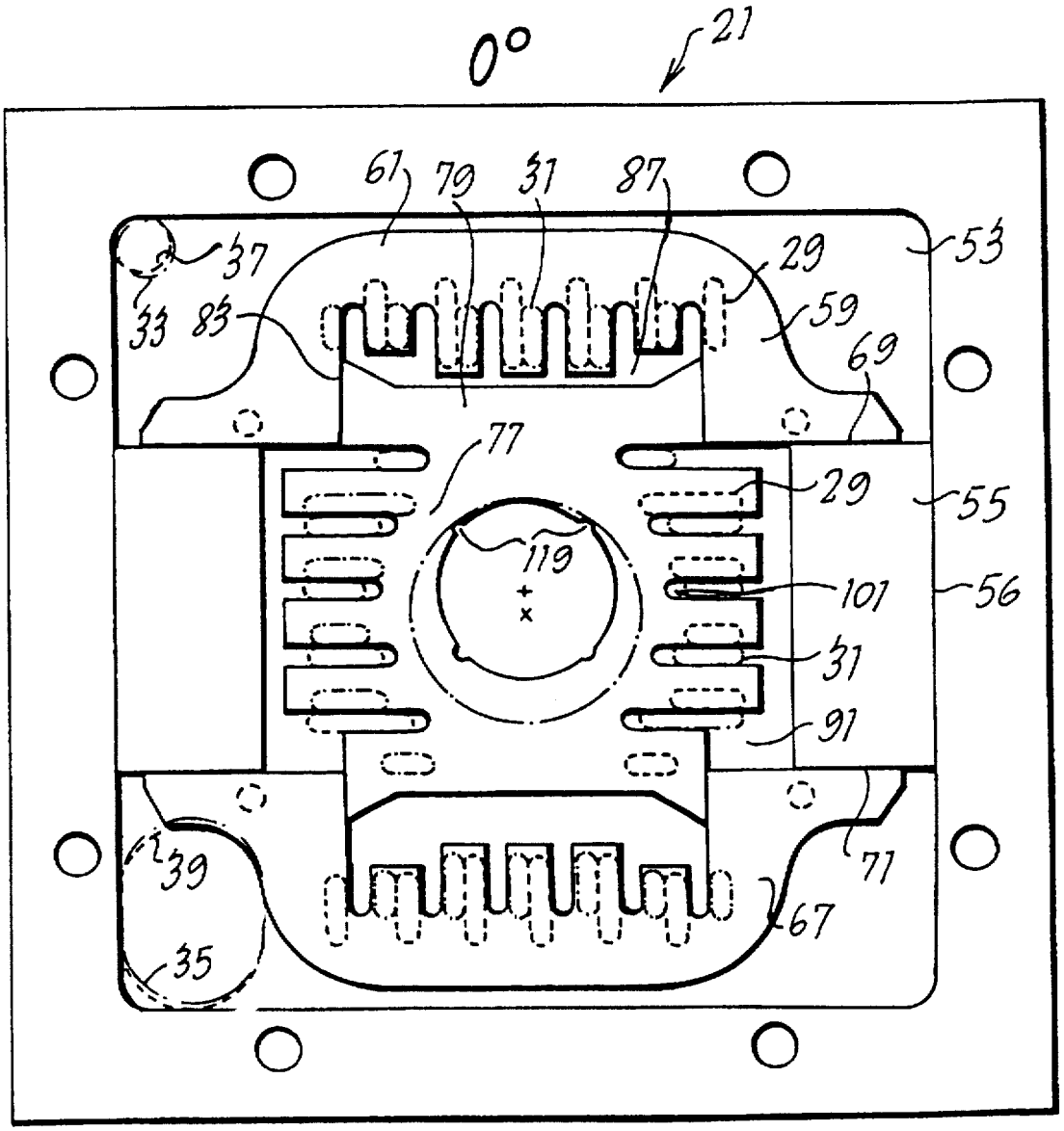
FIGS. 4 to 11 are further front views of the pumping unit of FIG. 2 showing its components in different positions.

FIG. 4 shows the pumping unit 21 in a nominal start position with the eccentric 97 at top dead centre. The impeller 77 is therefore in its uppermost position and, accordingly, the chamber 87 has its smallest volume. The slider 59 is in the centre position in which none of the slots 99 corresponds to any of the inlet ports 29 or the outlet ports 31.

Figure 5:
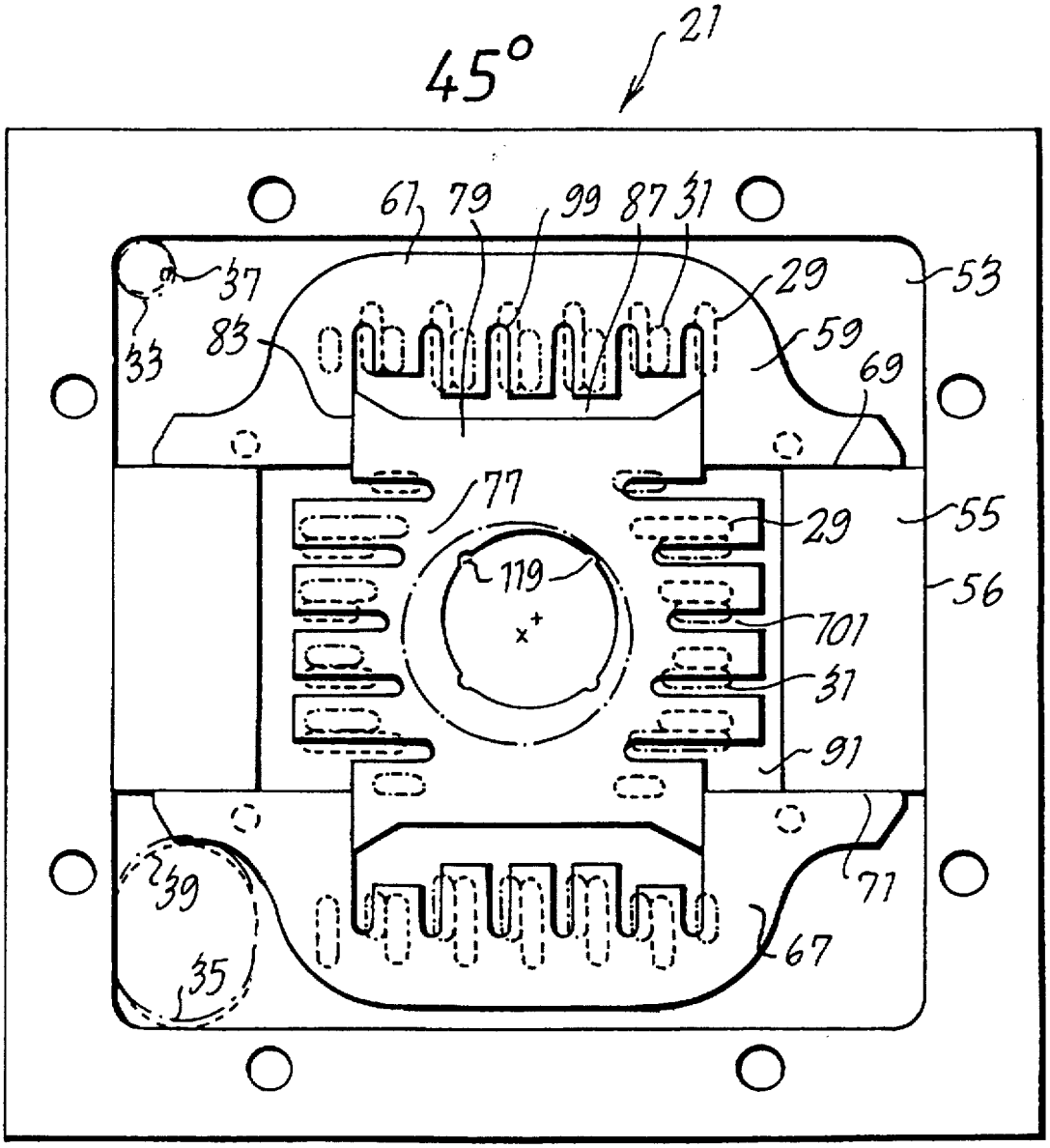

FIG. 5 shows the eccentric 97 after rotation in a clockwise direction by 45° thereby moving the impeller 77 downwardly and rightwardly. The rightward movement of the impeller 77 moves the slider 59 to the right, bringing the slots 99 into partial communication with the inlet ports 29. The downward movement of the impeller 77 expands the volume of the chamber 87 and draws fluid from the inlet space portion 27 (FIG. 2) through the inlet ports 29 and into the chamber.

Figure 6:
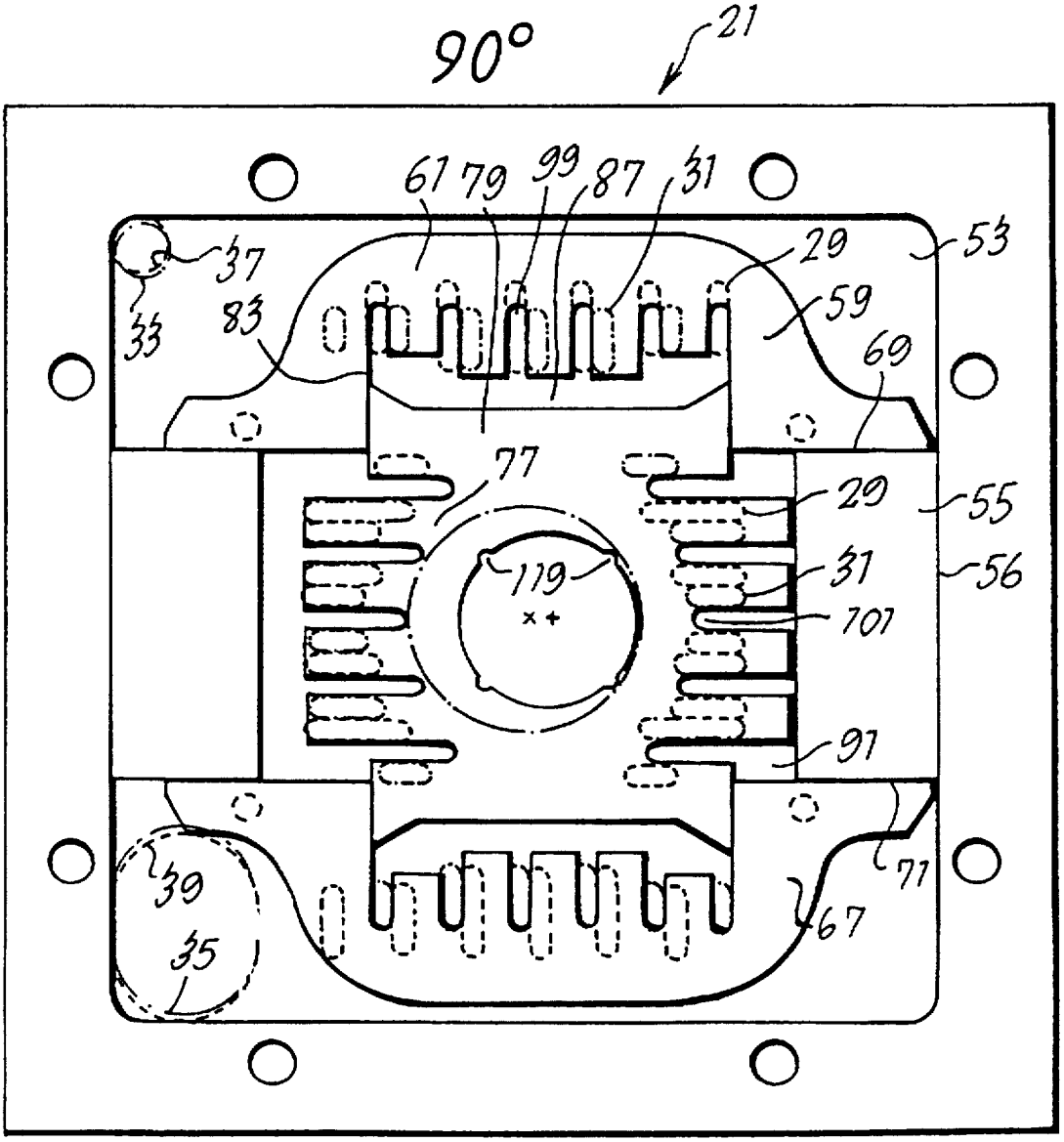

FIG. 6 shows eccentric 97 rotated by 90°, at which point the impeller 77 has moved to the midpoint of its downward movement and both the impeller 77 and the slider 59 have reached their rightmost position. The slots 99 have therefore moved into full correspondence with the inlet ports 29 and the chamber 87 has expanded further drawing in more fluid.

Figure 7:
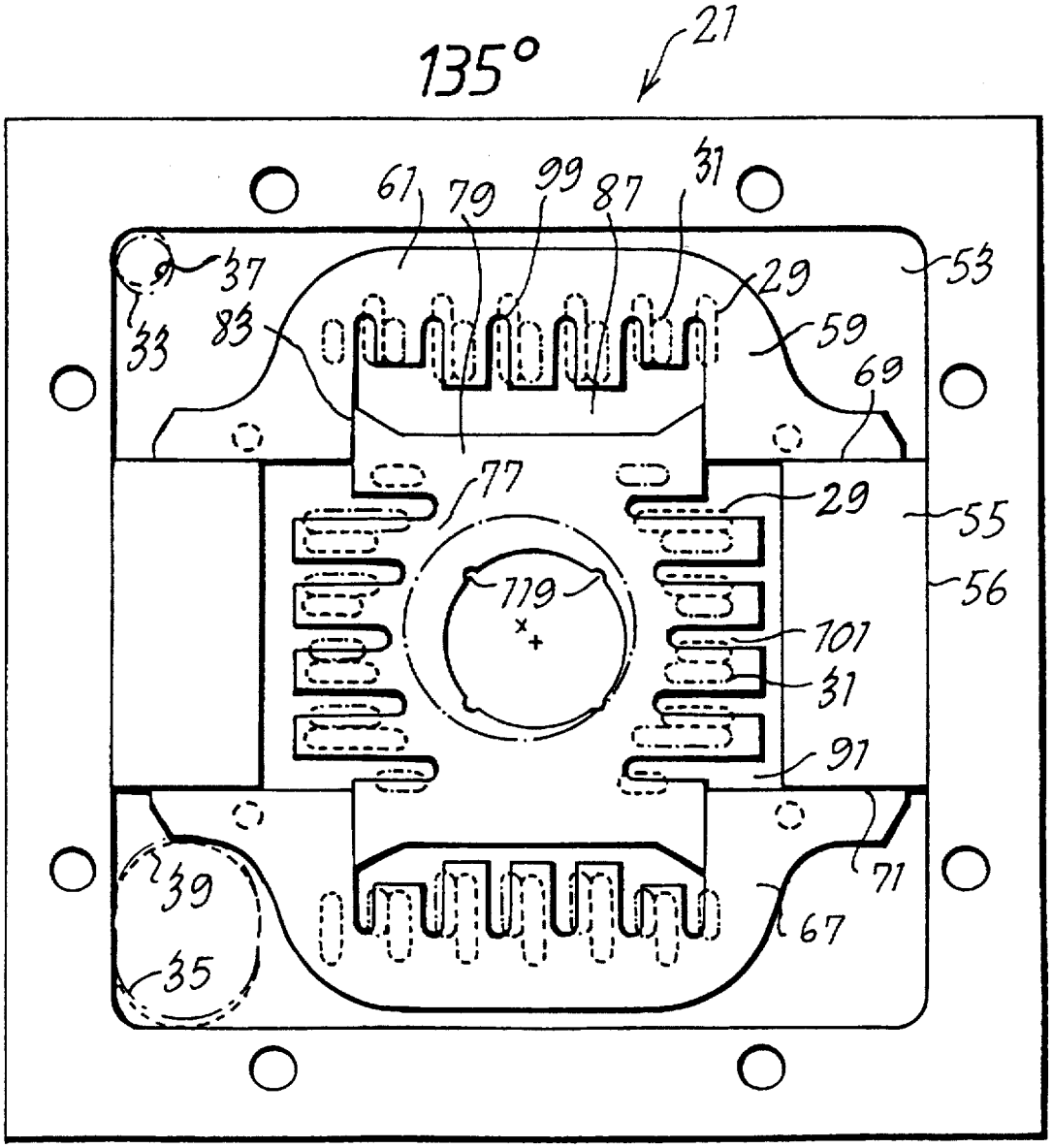

FIG. 7 shows the eccentric 97 rotated by 135° such that the impeller 77 and slider 59 have begun moving to the left. The slots 99 have resumed only partial correspondence with the inlet ports 29 and the chamber 87 has expanded yet further to draw more fluid into the chamber 87 through the inlet ports 29.

Figure 8:
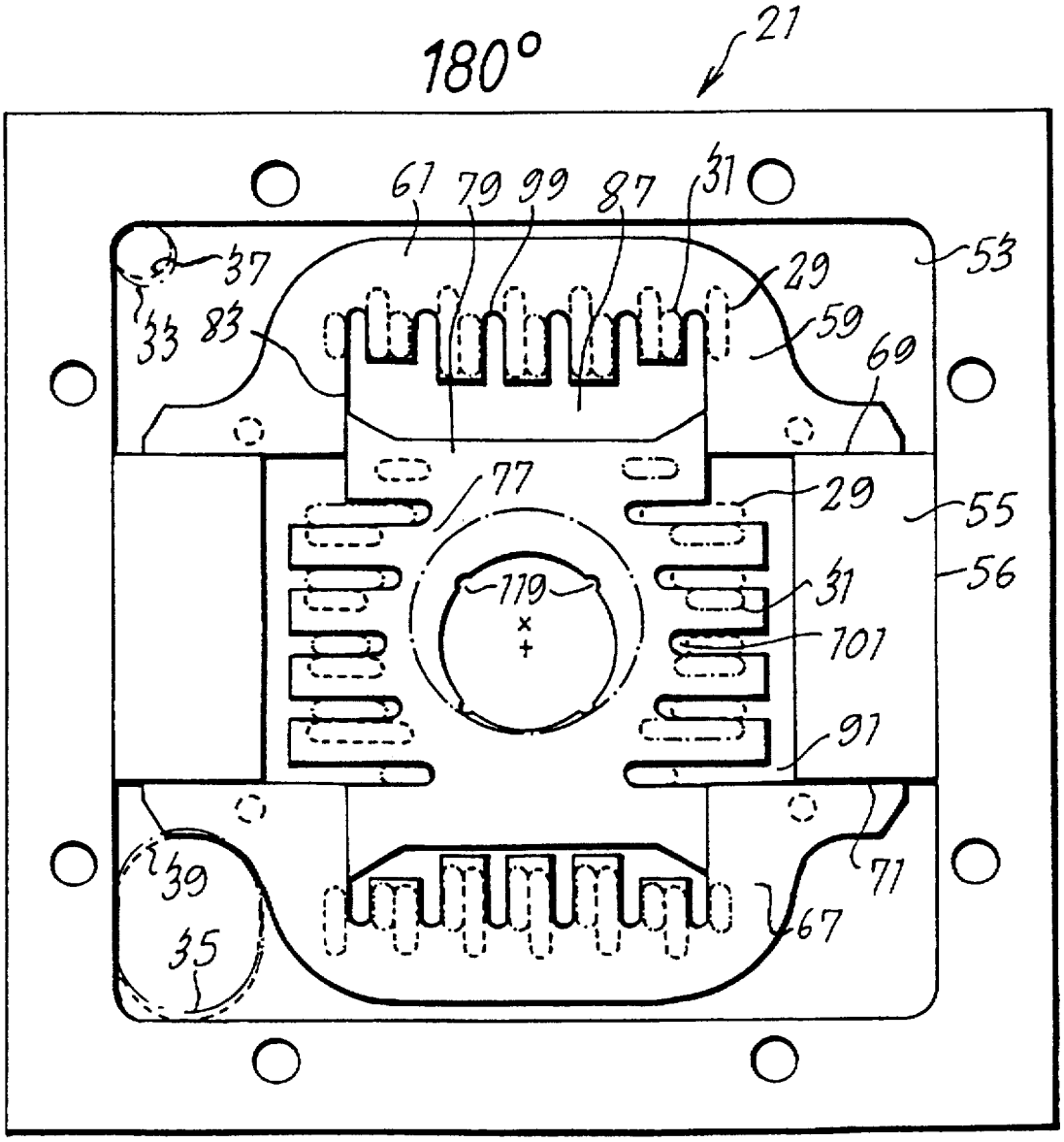

FIG. 8 shows the eccentric 97 rotated by 180°, at which point the impeller 77 has reached its most downward position and the slider 59 has resumed the centre position. The chamber 87 has expanded to its maximum volume and has filled with fluid. The slots 99 have moved completely out of communication with the inlet ports 29.

Figure 9:
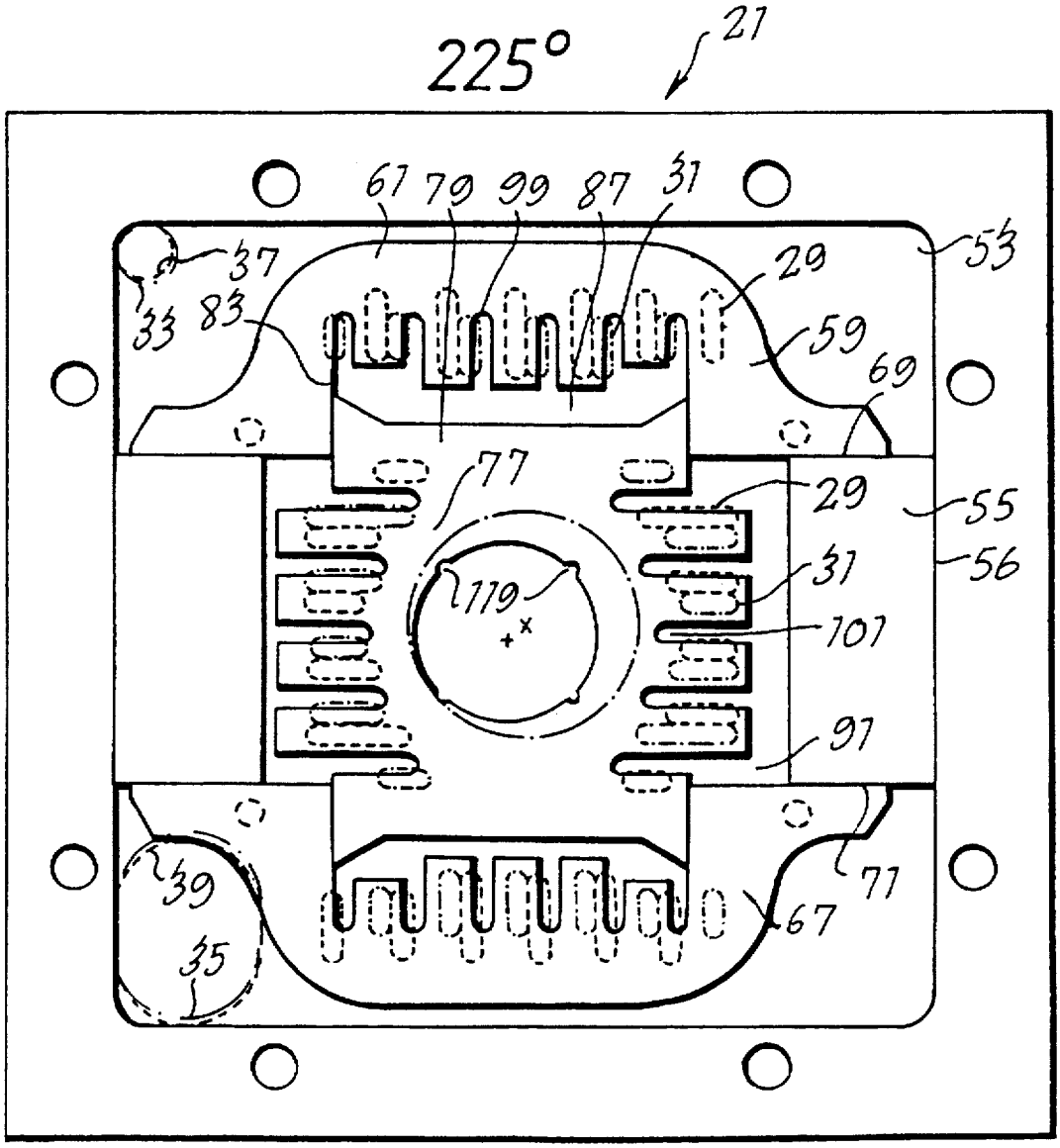

FIG. 9 shows the eccentric 97 having rotated 225° and moved the impeller 77 upwardly and the slider 59 leftwardly from the midpoint. The upward movement of the impeller 77 contracts the chamber 87, while the leftward movement of the slider 59 brings the slots 99 into partial communication with the outlet ports 31. The fluid in the chamber 87 therefore begins to be forced out of the chamber 87 via the outlet port 31.

Figure 10:
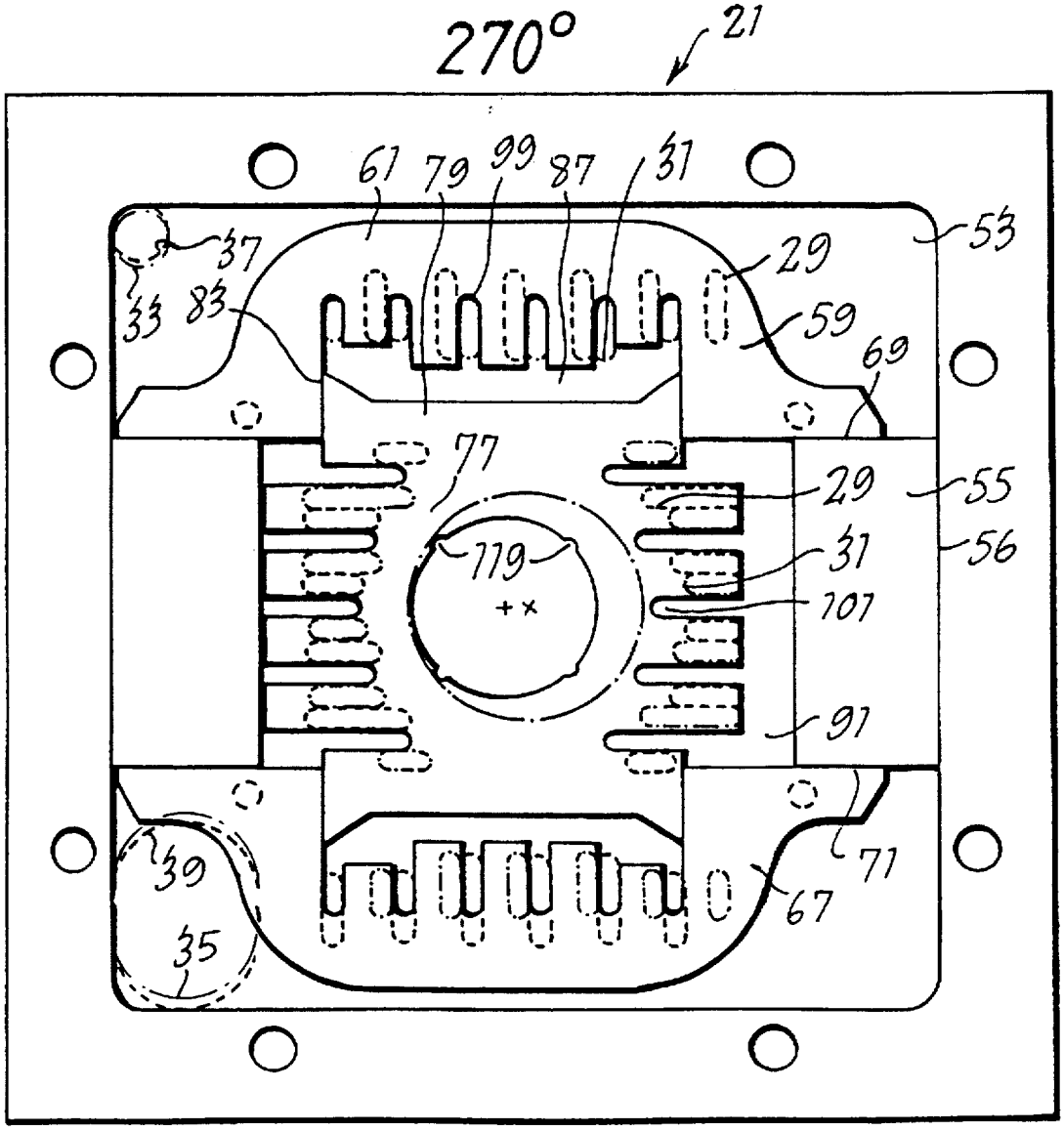

FIG. 10 shows the eccentric 97 rotated by 270°, at which point the impeller 77 has reached the midpoint in its upward movement and the slider 59 has been moved to its leftmost position. The chamber 87 has been contracted further and the slots 99 have been moved into complete communication with the outlet ports 31, thereby forcing out more of the fluid in the chamber 87 via the outlet ports 31.

Figure 11:
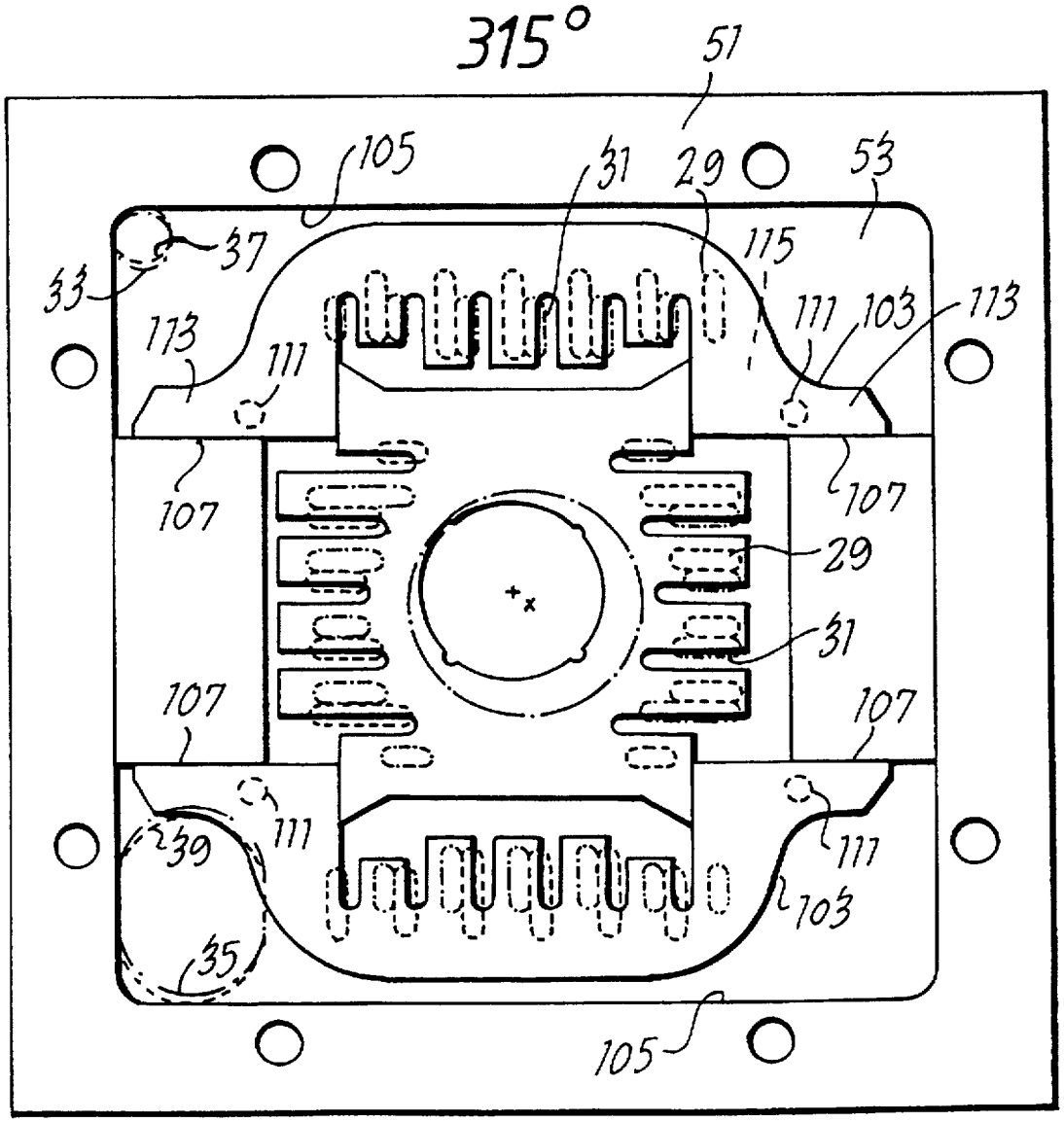

FIG. 11 shows the eccentric 97 rotated by 315°, at which point the impeller 77 has moved upwardly and moved the slider 59 to the right. Accordingly, the slots 99 remain in only partial engagement with the outlet ports 31 and further fluid is expelled from the chamber 87 as it is contracted by the upward movement of the impeller 77. As the eccentric 97 rotates further from this position the impeller 77 moves to its upmost position and more fluid is expelled from the chamber 87 as its volume decreases towards a minimum. As the eccentric rotates further, the slider 59 moves further towards the centre point, the slots 99 move to a position where they no longer communicate with the outlet ports 31 and the pumping unit resumes the 0° position shown in FIG. 4.

The pumping action of the lower chamber 89 will be identical to that of the upper chamber 87 described above, except that they will be 180° out of phase.

The pumping action of the right chamber 91 will now be described. As described above, FIG. 6 shows the eccentric 97 rotated 90° from the nominal start position shown in FIG. 4, at which the point slider 59 is in its rightmost position and the impeller 77 is in the centre of its downward movement. Accordingly, the chamber 91 is at its smallest volume and the slots 101 in the impeller 77 do not correspond to either the inlet ports 29 or the outlet ports 31.

As the eccentric 97 rotates further in a clockwise direction, the impeller 77 is moved downwards and to the left to the 135° position shown in FIG. 7. The downward movement of the impeller 77 has moved the slots 101 into partial communication with the inlet ports 29 and the leftward movement of the slider 59 has expanded the chamber 91 drawing fluid in through the inlet ports 29 into the chamber 91.

At 180° (FIG. 8), the impeller 77 has reached the bottom of its downward travel, moving the slots 101 into full communication with the inlet ports 29. The slider has been moved to its centre position, expanding the chamber 91 further, thereby drawing more fluid into the chamber 91 via the inlet ports 29.

At 225° (FIG. 9) the impeller has begun moving upwardly and returning the slots 101 into partial communication with the inlet port 29. The slider 59 has been moved further to the left, expanding the chamber 91 further and drawing more fluid into the chamber 91 via the inlet ports 29.

At 270° (FIG. 10), the impeller 77 has reached the midpoint of its upward movement bringing the slots 101 out of communication with the inlet ports 29. The slider has reached the left most position having expanded the chamber 91 to its largest volume and filled it with fluid.

At 315° (FIG. 11) the impeller has moved further upward to bring the slots 101 into partial communication with the outlet ports 31. The slider 59 has moved to the right, contracting the chamber 91 and pumping fluid from the chamber 91 out through the partially open outlet ports 31.

At 360° eccentric 97 has returned to the nominal start position (0°, FIG. 4). The impeller 77 has been moved to its uppermost position, in which the slots 101 are in full communication with the outlet ports 31 and the slider 59 has moved to the centre position, further contracting the chamber 91 and expelling fluid from the chamber 91 via the outlet ports 31.

At 450° (FIG. 5) the impeller 77 has begun to move downwardly, bringing the slots 101 to resume partial communication with the outlet ports 31. The slider 59 has moved further to the right, contracting the chamber 91 further and expelling more fluid from the chamber 91 via the outlet ports 31.

As the eccentric 97 continues to rotate, the impeller 77 moves further downward and rightward thereby moving the slider 59 further to the right until the 90° position (FIG. 6) is resumed in which further fluid has been pumped from the chamber 91 and the slots 101 have been moved out of communication with either the inlet ports 29 or the outlet ports 31 and the chamber 91 assumes its minimum volume.

The pumping action of the left chamber 93 will be identical to that described above in relation to the right chamber 91, except that they will be 180° out of phase.

With reference to FIGS. 4 to 11 as described above, as the eccentric 97 rotates, the vertical motion of the impeller 77 will be simple harmonic motion and, similarly, the side to side motion of the impeller, and of the slider 59 as it is pushed from side to side by the impeller 77, will also be simple harmonic motion. Additionally, the valve arrangements formed by ports 29, 31 and slots 99 and 101 described above result in the degree of correspondence between the slots 99, 101 and the ports 29,31 being proportional to the rate at which the respective chamber 87,89,91,93 is expanding or contracting and therefore proportional to the rate at which fluid is either being drawn into or pumped out of a given chamber. For example, with reference to FIG. 10 and as described above the impeller 77 is in the midpoint of its upward movement and travelling at its maximum velocity, thereby reducing the volume of the chamber 87 at the maximum rate in the cycle, and the slots 99 are in full correspondence with the outlet ports 31. FIG. 11 shows the impeller 77 having moved further upward and in this stage of the cycle, slowed from its maximum velocity thereby reducing the rate at which the volume of the chamber 87 is reducing and, accordingly, the degree of correspondence of the slots 99 and the outlet ports 31 has also decreased. This feature, combined with four chambers 87,89,91,93 with their drawing and pumping actions timed at 90° intervals of rotation of the shaft 9 provides a substantially smooth flow through the pump.

As described above with reference to FIG. 2, the fluid pumped by the pumping unit 21 out through the outlet port plate 23 via the outlet ports 31 is forced to flow back through the upper and lower return ports 33,35 in the outlet port plate 23 and back into the pumping unit 21. With reference to FIG. 11, the fluid flows into the interior 53 of the pumping unit 21 filling the space between the inlet and outlet port plates 19,23, the outward facing walls 103 of the slider and the interior wall 105 of the spacer ring 51. Accordingly, as the slider 59 moves from left to right the bearing surfaces 69,71,73,75 of the slider and the outward facing surfaces 107 of the blocks 55,57 are wetted and therefore lubricated by the fluid being pumped. In addition, lubrication ports, 111 may be provided in the outlet port plate 23 and the inlet port plate 19 respectively. The ports 111 allow fluid from the return manifold 25 to wet the face 113 of the slider 59 and similarly the ports 111 permit fluid from the inlet space 27 of the inlet/outlet manifold 13 to wet the back face 115 of the slider 59. Additionally, the ports 29 may be extended radially so as to provide access for lubrication to the surfaces of the slider 59.

Further, since, even when a given chamber 87,89,91,93 is at its minimum volume, a residual amount of fluid can remain in the chambers to wet and lubricate the internal surfaces of the chamber. Also, fluid is permitted to enter the axial grooves 119 (shown in FIG. 3) in the bore 95 of the impeller 77 for wetting and lubricating the eccentric 97. The fluid enters the axial grooves from the return manifold via a hole in the outlet port plate 23 shown in FIG. 2.

With reference to FIG. 2, when the flow of fluid supplied to fluid inlet 15 is interrupted, air (or other gas) is instead drawn into the pumping unit 21. This air is pumped out into the return manifold 25 and tends to exit the pump via the upper return ports 33,37. This ensures that a body of fluid remains in the pump assembly 3, and particularly in the whole interior of the pumping unit 21, thereby maintaining the slider 59 and the impeller 77 submerged in the fluid and with their moving surfaces wetted. This feature allows the pump to continue to run while no fluid enters the fluid inlet 15, and at the same time maintaining the sealing of the chambers 87,89,91,93 so that the ability of the pumping unit 21 to draw in subsequently provided fluid through the fluid inlet 15 is maintained. As will be appreciated by those skilled in the art, this removes the need to prime the pump.

It will also be appreciated by those skilled in that art that acceptable clearances between the moving parts of the pumping unit 21 depend upon the viscosity and to some degree on the lubricating qualities of the fluids to be pumped. However, the sealing of the chambers 87,89,91,93 may be improved by providing an outlet port plate 23 which is resiliently deformable so that the pressure of the pumped fluid in the return manifold 25 urges the resiliently deformable port plate 23 against the corresponding faces of the slider 59, impeller 77, and blocks 55,57. This process improves the sealing on both sides of the slider 59 and impeller 77 because they are both free to move axially in response to the urging force.

Because liquid at discharge pressure is present in all parts of the pump except the suction space, the squeezing effect on the working parts is not excessive and is only effective upon the inlet port plate 19 and those parts which at a given time are in communication with the ports in this plate.

The minimum volumes of the chambers 87,89,91,93 and the size of the inlet and outlet ports 29,31 may be provided so that solid particles up to a predetermined size may pass through the pumping chamber 87,89,91,93 without hindering the pumping action.

The volume of fluid pumped through a revolution is dependent on the change in volume of the chambers 87,89, 91,93. Pumps of different pumping capacity may be provided by increasing or decreasing the change in volume per cycle of each chamber. This may be achieved by increasing the eccentricity of the eccentric and modifying the chambers accordingly to increase the volume of their stroke. Alternatively, however the volume of the chamber may be increased in the axial direction, simply by increasing the axial dimensions of each of the parts shown in FIG. 3. In this way, the pumping performance of the pumping unit 21 may be increased or decreased without the necessity of changing the dimension or design of the port plates 19,23 or manifolds 13,25.

The interior 53 of the pumping unit 21 may be inspected and cleaned by removing the return manifold 25 and the outlet port plate 23 so as to expose all the parts of the pumping unit 21 for removal, cleaning and inspection. By removing a screw, the eccentric 97 and the mechanical seal may also be withdrawn. A balance weight can be provided on the shaft 9, for example surrounded by a nylon fairing. These components can be made small enough to allow the outlet port plate 23 to be removed while they remain in situ. In practice the balance weight can be larger, or it may be omitted altogether, as shown in the drawings.

Figure 12:
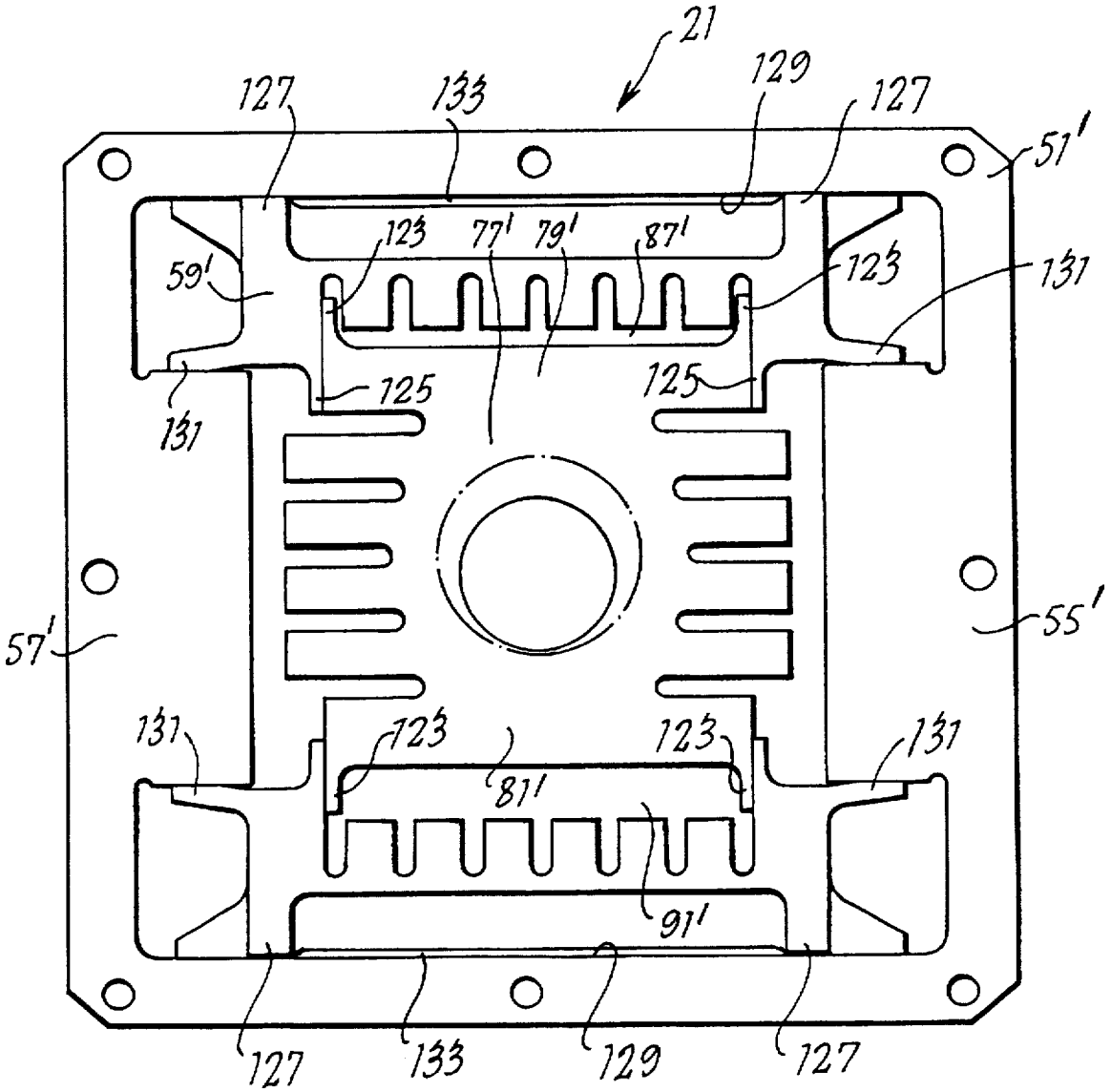
FIG. 12 is a front view of a pumping unit according to a second embodiment of the invention.

FIG. 12 shows a front view of the pumping unit 21 according to a second embodiment of the invention. In this embodiment, the impeller 77' has flexible flaps 123 formed on the outward corners of its upper and lower ends 79',81' and the slider 59' has similarly formed flaps 125 on the inward edges of the spaces 83,85. These flaps 123,125 have the effect of providing further sealing of the chamber 87' during the contraction and expansion of the chambers 87', 91'. As the chambers 87',91' are contracted, the flaps 123 are urged outwardly to bear against the base of the flaps 125 to form a seal between the ends 79',81' of the impeller 77' and the remainder of the chambers 87',91'. When the chambers 87',91' are expanded the flaps 125 act in a similar manner to seal the chambers 87',91'. In this way the flaps operate to decrease the amount of fluid which can leak between adjacent chambers when pressure differentials exist between those chambers.

The slider 59' is further modified by the provision of bearing members 127, with a space 133 between them, which are in sliding contact with the interior wall 129 of the spacer ring 51'. These bearing members 127 remove the load bearing function from the ends 131 of the slider 59' which slidably bear against the blocks 55',57'. This modification reduces the wear between the slider 59' and the blocks 55',57' and so helps to maintain the seal between these two parts, while the slideways for the bearing members 127 on the wall 129 can be of more generous proportions, and provided with lubricating grooves. The space 133 is provided to give clearance between the top and bottom of the slider 59' and the spacer ring 51'. This clearance will take up the outward flexing of the slider 59' which may occur in use. This modification allows the ends 131 to be of thin section so that they act as flexible flaps which improves the seal between the slider 59' and blocks 55',57'. It will also be seen from FIG. 12 that the blocks 55',57' are formed as an integral part of the spacer ring 51', a modification which can equally be applied in the first embodiment.

It can also be seen that the embodiment shown in FIG. 12 provides wider displacement chambers and hence greater pumping capacity than that shown in FIGS. 1–11. The process may be taken a stage further by widening the blocks 55', 57' until their upper and lower surfaces coincide with the walls 129 and the entire end of the pump becomes a displacement chamber of the greatest possible size.

Shallow grooves can be provided at appropriate points in the surface of the yokes to assist in the distribution of liquid for lubrication between the yokes and the port plates.

It will be seen that this pump of either embodiment will work in identical fashion if it is run in reverse. The pressures achievable may be limited by the tendency of the port plates 19, 23 to bulge apart rather than to squeeze inwards, but this reverse pumping will be sufficiently effective to allow the back-flushing which is an important part of many industrial processes.

It will also be seen that, because of the close sealing and positive displacement which are present, the pump may be used as a gas compressor, or as a motor operated by hydraulic or pneumatic power.

In FIG. 1 the pump 1 is shown with a drive means 5 for attaching a belt to drive the pump. Alternatively the pump assembly can be face mounted on the driving motor with an eccentric mounted on the motor spindle to drive the pumping unit 21.

In some applications it may be preferable to provide a pump with fewer than four chambers in which case the pump may become more compact. Also, it will be appreciated that many variations of the structure of the pump are possible within the same basic principles of construction and operation. Further, the yokes or their equivalent need not be constrained to strictly linear motion, but can be mounted to the spacer ring 51 (for example) by a pair of blade springs or the like. The yokes and springs may even be moulded in one piece with the spacer ring 51. In other embodiments having two slider yokes, these need not be rigidly connected. For example, the yokes need not be formed separately and then connected by rods 63,65. The rods or equivalent connecting members can be moulded integrally with the yokes to form a single sliding ring structure.

Also, for each displacement chamber the inlet valve and the outlet valve can be of different construction or different location, if desired: both need not be operated by the same operating part; both need not be side valves or be located in opposite plates of the pumping unit. As another example, the impeller or other driving member need not be the central one of the operating parts: the oscillating slider can equally be located centrally, surrounded by an appropriately shaped impeller.

The parts of the pump described in the above embodiments may be made out of various materials, the choice depending to some degree on the particular application envisaged for the pump. Suitable materials may be as follows:

Port plate 19: for exceptionally arduous conditions, stainless steel cast or machined from plate; otherwise, phenolic laminates such as Tufnol, or UHD polythene, or polyurethane of various hardnesses. Also rubber/nylon alloys such as Absynt or Nyrim.

Slider 59 & impeller 77: all the above materials except steel. The impeller and yokes can be made from a material having low specific gravity, mouldability and ability to deform slightly under pressure and thus to close up clearances caused by errors in manufacture or by wear. Polyurethane in particular combines abrasion resistance, mechanical strength and cheapness of manufacture. In food, drink and pharmaceutical applications, cast nylon, polyacetal and PTFE composites might arise.

Outlet port plate 23: preferably this is slightly flexible, and may also act as a gasket. Hence polyurethane, UHD polythene, nylon, PTFE composites or Tufnol in extra arduous cases.

Spacer 51 and manifolds 13,25: cast aluminium alloy or any other castable metal including stainless steel. The embodiments have structures which allow the walls to be relatively thick so that the plastic materials currently being introduced for pump bodies can be used, eg cast nylon alloys.

Other materials of use may be epoxy, polypropylene, Ryton, Kynas, Viton, carbon, ceramic (port plates only).

The invention is not limited to the applications outlined above, and may be applied at much larger scales or smaller scales, for example by micromachining.

From reading the present disclosure, other modifications will be apparent to persons skilled in the art. Such modifications may involve other features which are already known in the design, manufacture and use of pumps, motors, compressors and component parts thereof and which may be used instead of or in addition to features already described herein. Although claims have been formulated in this application to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicant hereby gives notice that new claims may be formulated to such features and/or combinations of features during the prosecution of the present application or of any further application derived therefrom.

I claim:

1. A pump in which a driving member (77) having substantially flat faces is sandwiched between first and second fixed walls (19, 23) and arranged for orbital motion, said driving member (77) co-operating with one or more sliding members (59) disposed in an operating space between said walls (19, 23), so as to impart oscillating motion to the one as more sliding members (59), the shape of the driving member (77) and sliding member (59) being such that at least one displacement chamber (87, 89, 91, 93) is formed between the driving member and the one or more sliding members, and between the walls (19, 23), so as to expand and contract in synchronism with the motion of the driving member (77), wherein valve means (29, 31, 101, 99) include at least one port (29, 31) for suction formed in said first wall (19), which will be covered and uncovered by part of one of the driving and sliding members (77, 59) synchronously with said motion, so as to cause fluid to be pumped through the chamber (87, 89, 91, 93) characterised in that the fluid is pumped substantially in the direction from one of said walls (19, 23) to the other (19, 23).

2. A pump as claimed in claim 1 wherein a first pair of such displacement chambers (87, 89) are arranged diametrically opposite one another about an axis of said motion, and include respective sliding valve means (31, 99) formed partly by the one or more sliding member(s) (59), while a second pair of such displacement chambers (91, 93) are arranged diametrically opposite one another so as to operate in quadrature with said first pair of displacement chambers (87, 89) during said motion, and communicate with respective valve means (29, 101) formed partly by parts of the driving member (77).

3. A pump as claimed in claim 1 or 2 wherein at least one of said walls (19, 23) is arranged to flex during operation, in response to discharge pressure of the pump, so as to enhance sealing between different spaces within the pump (1).

4. A pump as claimed in claim 1 or 2, wherein said walls (19, 23) are formed by first and second plates with the operating space in between, and are disposed within a vessel (13, 25) such that the vessel (13, 25) is divided into a suction space (27) and discharge space (25), said spaces being connected respectively to an inlet and outlet (15, 17) of the pump.

5. A pump as claimed in claim 4 wherein the pump further comprises means (33, 35, 37, 39) for communicating fluid at discharge pressure from said discharge space through said plates (25) and operating space (21) into an outlet space (41) located on the same side of the operating space (21) as the suction space (27).

6. A pump as claimed in claim 5 wherein said outlet space (41) and suction space (27) are defined by a common manifold (13) coupled to said first plate (19).

7. A pump as claimed in claim 1 wherein in operation an operating space (21) between the two walls (19, 23) but outside the displacement chamber(s) (87, 89, 91, 93) contains fluid at discharge pressure.

8. A pump as claimed in claim 7 wherein at least one part of the pump within the operating space is provided with a deformable portion (123, 125, 131) so as to enhance sealing of the displacement chamber (87, 89, 91, 95) during suction, in response to the discharge pressure.

9. A pump as claimed in claim 8 wherein said deformable portion (123, 125) is provided so as to enhance sealing between the driving member (77) and the one or more sliding members (59) of the pump.

10. A pump as claimed in claim 8 or 9 wherein said deformable portion (131) is provided so as to enhance sealing between the sliding member (59) and a stator (51, 55, 57) of the pump.

11. A pump as claimed in claim 1 comprising, in relation to the displacement chamber (87, 89, 91, 95), a suction port formed (29) in said first wall (19) and a discharge port (31) formed in said second wall (23), said member(s) (59, 77) being formed so as to uncover said suction and discharge ports (29, 31) at different respective portions of said operating cycle.

12. A pump as claimed in claim 11 wherein said suction and discharge ports (29, 31) are disposed generally opposite one another, and wherein one of said driving and sliding members (59, 77) has a covering portion extending between both walls (19, 23), thereby to define first and second valve means (29, 31, 101, 99) of the said displacement chamber (87, 89, 91, 93).

13. A pump as claimed in claim 1 wherein two sliding members (61, 67) are arranged on opposite sides of the driving member (77) so as to define at least one pair of displacement chambers (87, 89).

14. A pump as claimed in claim 13 wherein said sliding members (61, 67) are rigidly connected so as to slide in unison, synchronously with the cyclic travel of the driving member (77).

15. A pump according to claim 1 wherein the driving member (77) surrounds the one or more sliding members(s) (61, 67) within the operating space (21).

16. A pump as claimed in claim 1 further comprising eccentric drive means (97) for imparting motion to said driving member (77) within the operating space (21), the one or more sliding member(s) (61, 67) operating to constrain the driving member (77) in the orbital motions.

17. A pump as claimed in claim 1 wherein faces (127) of the one or more sliding member (59) which bear forces normal to the axis of the orbital motion in the course of said oscillating motion are separate from portions (131) of the one or more sliding member (59) which provide a seal between the displacement chamber (87, 89, 91, 93) and the remainder of the operating space (21).

18. A pump comprising first and second walls, a driving member and at least one sliding member, in which the driving member has substantially flat faces, is sandwiched within an operating space defined between said first and second walls and is arranged for orbital motion, said driving member co-operating with the sliding member(s) also disposed within the operating space, so as to impart oscillating motion to at least one sliding member(s), the shape of the driving member and at least one sliding member being such that at least one displacement chamber is formed between the driving member and the at least one sliding member and between the walls so as to expand and contract in synchronism with the motion of the driving member, wherein said walls and operating space are disposed within a vessel such that the vessel is divided into a suction space and discharge space, said spaces being connected respectively to an inlet and outlet of the pump, and wherein at least one of said walls is arranged to flex during operation, in response to discharge pressure of the pump, so as to enhance sealing between the walls and operating parts within said operating space.

19. A pump comprising two fixed walls, a driving member and at least one sliding member, the driving member having substantially flat faces and being sandwiched within an operating space defined between the walls and being arranged for orbital motion, the driving member co-operating with at least one sliding member(s) also disposed within the operating space so as to impart oscillating motion to at least one sliding member(s), the shape of the driving member and sliding member(s) being such that four displacement chambers are defined within the operating space, a first pair of the four displacement chambers being diametrically opposite one another about an axis of said motion, and including sliding valve means formed partly by at least one sliding member(s), while a second pair of the four displacement chambers are arranged diametrically opposite one another so as to co-operate in quadrature with said first pair of displacement chambers during said motion, and communicate with respective valve means formed partly by parts of the driving member.

20. A pump assembly comprising a pump in which a driving member having substantially flat faces is sandwiched between first and second fixed walls and arranged for orbital motion, said driving member cooperating with one or more sliding members disposed in an operating space between said walls, so as to impart oscillating motion to the one or more sliding members, the shape of the driving member and sliding member being such that at least one displacement chamber is formed between the driving member and the one or more sliding members and between the walls, so as to expand and contract in synchronism with the motion of the driving member, wherein valve means include at least one port for suction formed in said first wall, which will be covered and uncovered by part of one of the driving and sliding members synchronously with said motion, so as to cause fluid to be pumped through the chamber characterized in that the fluid is pumped substantially in the direction from one of said walls to the other and the pump assembly having inlet and outlet spaces on one side of the pump, and a return space on the other side of the pump, the return space communicating via said pump with said outlet space, the pump being provided with a communication port to permit discharge of air or other gas during dry suction, while a substantial body of liquid remains in said return space and pump so as to maintain sealing within the pump during said dry suction.

* * * * *